US006647687B2

(12) United States Patent
Kern

(10) Patent No.: US 6,647,687 B2
(45) Date of Patent: Nov. 18, 2003

(54) SIMULATED LOG SIDING

(75) Inventor: Michael J. Kern, Fremont, OH (US)

(73) Assignee: Poly-Foam International Incorporated, Fremont, OH (US)

( * ) Notice: Subject to any disclaimer, the term of this patent is extended or adjusted under 35 U.S.C. 154(b) by 8 days.

(21) Appl. No.: 09/778,488

(22) Filed: Feb. 7, 2001

(65) Prior Publication Data

US 2001/0017020 A1 Aug. 30, 2001

Related U.S. Application Data

(63) Continuation-in-part of application No. 29/117,605, filed on Jan. 27, 2000.

(51) Int. Cl.[7] ..... E04B 2/00

(52) U.S. Cl. ..... 52/506.05; 52/233; 52/246; 52/527; 52/529; 52/522; 52/531

(58) Field of Search ..... 52/233, 546, 527, 52/529, 522, 531

(56) References Cited

U.S. PATENT DOCUMENTS

| | | | | |
|---|---|---|---|---|
| 2,250,764 A | | 7/1941 | Hoess | |
| 2,777,549 A | * | 1/1957 | Roebuck | 52/529 |
| 3,869,332 A | * | 3/1975 | Loew | 156/63 |
| 4,305,238 A | | 12/1981 | Harward et al. | |
| D291,249 S | | 8/1987 | Manning | |
| 4,878,328 A | | 11/1989 | Berge | |
| 5,181,358 A | | 1/1993 | Mead | |
| 5,271,878 A | | 12/1993 | Mizia et al. | |
| D366,534 S | | 1/1996 | McMahon | |
| 5,586,422 A | * | 12/1996 | Hoffner | 52/233 |
| 5,694,728 A | | 12/1997 | Heath, Jr. et al. | |
| 5,768,844 A | * | 6/1998 | Grace et al. | 52/529 |
| 5,878,542 A | | 3/1999 | Cornelius | |
| 5,979,135 A | * | 11/1999 | Reeves | 139/383 R |
| 6,122,877 A | | 9/2000 | Hendrickson et al. | |

OTHER PUBLICATIONS

"Vinyl Siding" from www.shoresiding.com/html/siding-.html.

B&W Construction from www2.mo–net.com/~bw–constr/ dated 1997 Quantum Internet Solutions.

"Logsiding.com for all your log siding needs", from www.logsiding.com/wood_paneling_prices.htm.

"Log Siding" from www.inu.net/loghome/logsiding.html.

"Log Siding" from www.heartwoodlogon.com/LogSiding-.html.

* cited by examiner

*Primary Examiner*—Carl D. Friedman
*Assistant Examiner*—Steve Varner
(74) *Attorney, Agent, or Firm*—Calfee, Halter & Griswold, LLP

(57) ABSTRACT

Siding is provided for protective use on a structure. The siding simulates log construction and includes one or more panels which each include a top section, mounting section, flat section, female locking flange section, bowed section and male locking flange section. Each panel may be textured to simulate real logs. A film can be adhesively attached to the surface of the panels to simulate wood grain, as well.

7 Claims, 3 Drawing Sheets

SIMULATED LOG SIDING

RELATED APPLICATIONS

This is a continuation-in-part of application Ser. No. 29/117,605, filed Jan. 27, 2000, now pending.

FIELD OF THE INVENTION

This invention relates to siding for use on structures and more specifically to siding simulating log construction.

BACKGROUND OF THE INVENTION

Protecting the surfaces of a structure is important to preserve the integrity of the structure. Adding siding to a structure is an easy and inexpensive way to achieve this preservation. Siding has the added advantage of being aesthetically pleasing. Siding is often manufactured to simulate traditional construction materials in order to provide the functional and decorative characteristics of those materials. Siding typically simulates board construction, such as wooden lap siding, but can also simulate log construction.

U.S. Pat. No. 5,181,358 shows a simulation log siding apparatus. This apparatus does not have interlocking panels which provide efficient drainage of water. Water may instead pool in joints between the interlocking panels. U.S. Pat. No. 5,586,422 describes log illusion vinyl log siding. Although showing logs, this siding does not display the mortared joints, known as chinking, between the individual logs.

A siding which strongly simulates the functional and decorative aspects of log construction is desired.

SUMMARY OF THE INVENTION

The present invention is directed to an inexpensive siding which strongly simulates log construction. The siding includes a panel having a C-shaped top section, a mounting section with a plurality of slots, a flat section, a female locking flange section, a bowed section, and a male locking flange section.

The present invention is also directed to a siding comprising two or more of the above-mentioned panels. The present invention is still further directed to a siding including the above mentioned panel which is textured to simulate wood grain. Furthermore, siding of the present invention can include an adhesively attached outer film to simulate wood grain and/or mortar, which can be applied over the smooth or textured surface of the siding panels of the present invention. These and other features, aspects and advantages of the present invention will be fully described by the following description, appended claims, and accompanying drawings.

DESCRIPTION OF THE PREFERRED EMBODIMENT

Figure 5:
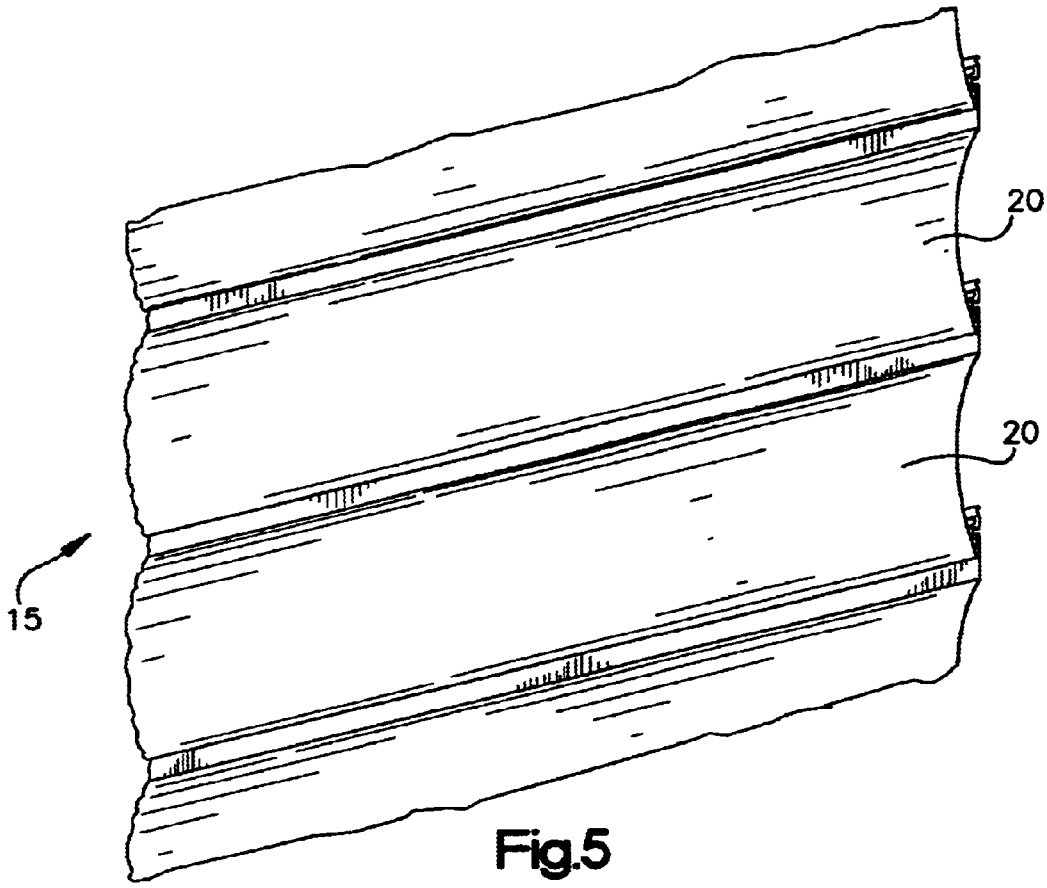
FIG. 5 is a perspective view depicting multiple siding panels connected together.
Figure 6:
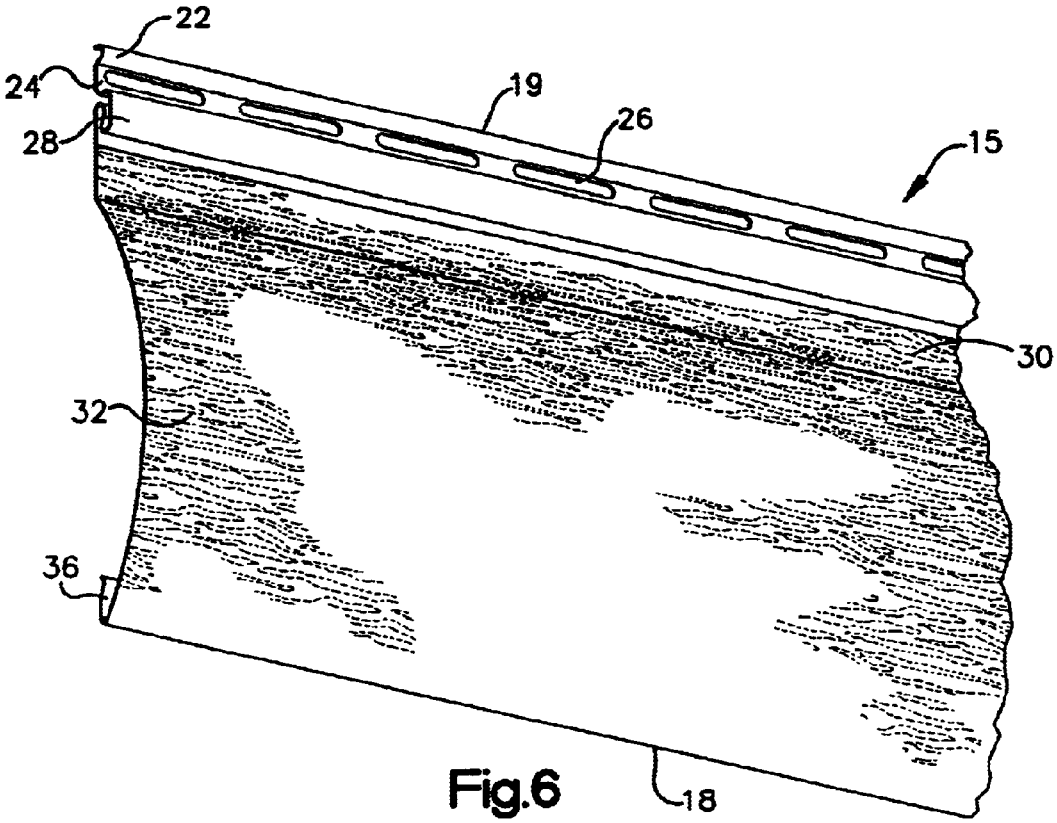
FIG. 6 is a perspective view of a siding panel of the present invention including a textured surface.

Referring to the drawings, FIG. 5 shows the siding 15 of the present invention. The siding comprises one or more elongate panels 20. As shown in FIG. 6, each panel includes an integrally formed top section 22, mounting section 24, female locking flange section 28, flat vertical section 30, bowed section 32, and male locking flange section 36.

Figure 7:
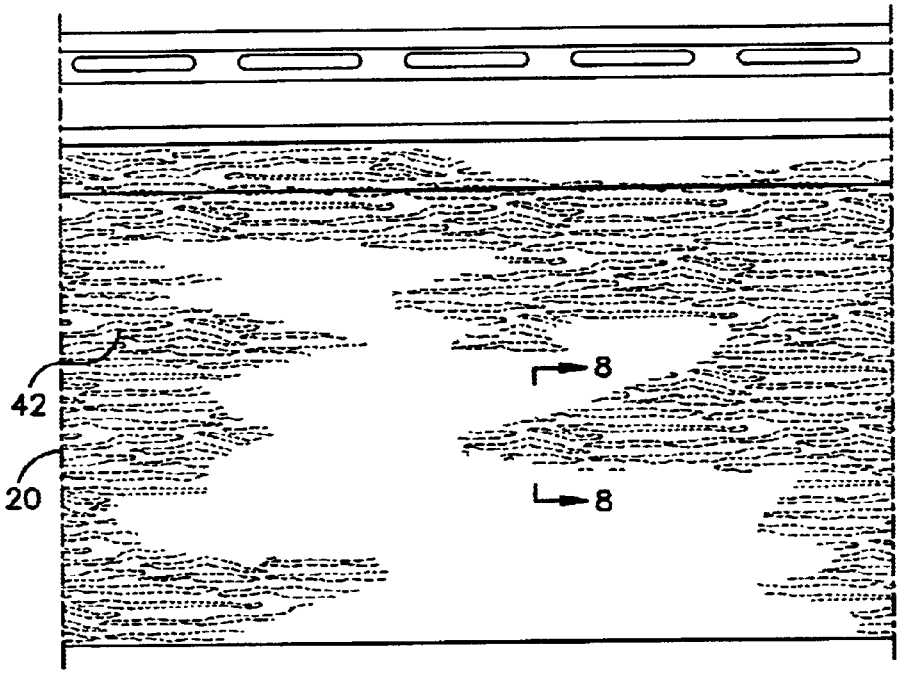
FIG. 7 is a front view of the siding panel of FIG. 6 including a textured surface.
Figure 8:
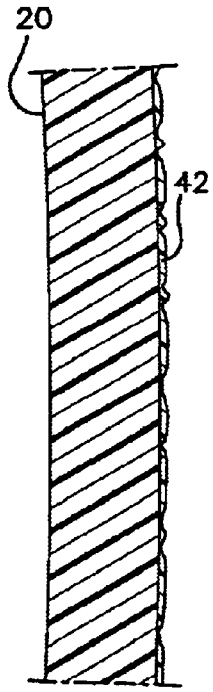
FIG. 8 is an enlarged cutaway view of the siding panel including a textured surface.

The siding 15 is applied to a structure such as a house, garage, barn, shed, manufactured home or mobile structure such as a motorized vehicle, trailer or other towable structure. The siding 15 is made of one or more panels 20 which can be interlocked. The panels 20 can be oriented horizontally and attached to the structure using fasteners such as nails, screws, staples, adhesive, or the like. As the panels 20 are attached they are stacked in a vertical manner to achieve full coverage of the structure. The panels 20 can be made of materials such as Polyvinyl Chloride (PVC), fiber reinforced polymers, and aluminum. Coloring can be added to the PVC or polymer mix during the manufacturing process to give the finished panel a desired color. The surface of panel 20 may include texturing 42 as shown in FIGS. 6–8. Texturing 42 is used to simulate the grain of wood or bark on the exterior of a log.

Figure 1:
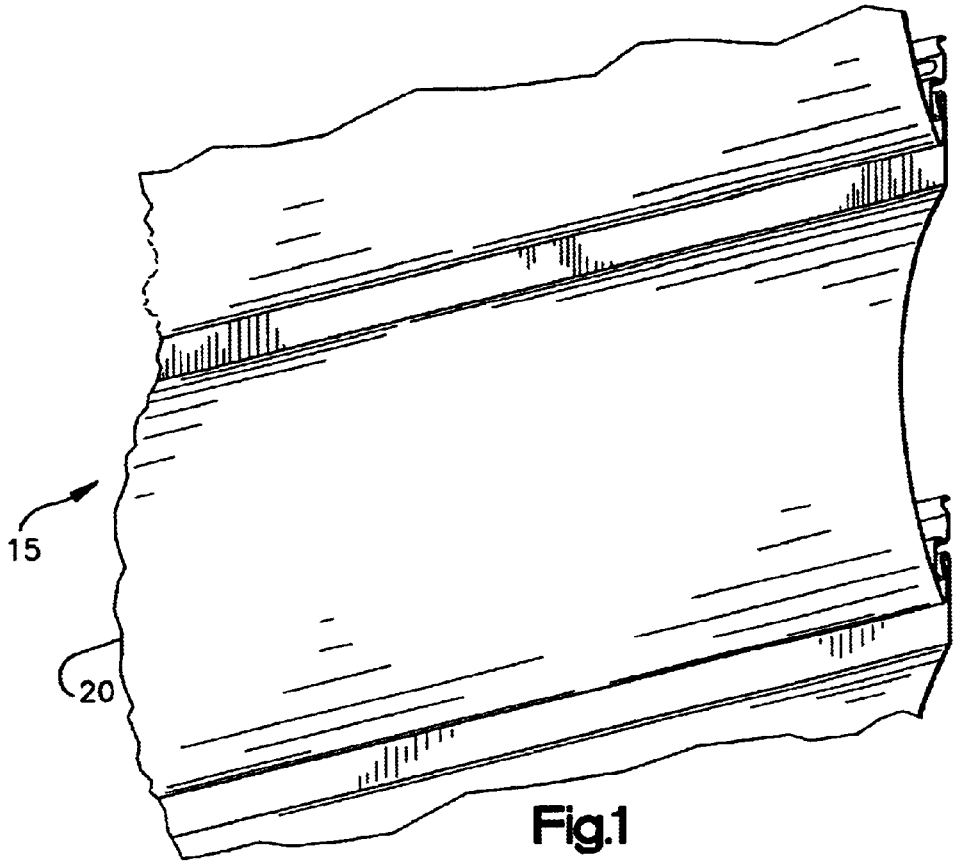
FIG. 1 is a perspective view of a siding panel in accordance with the present invention.
Figure 2:
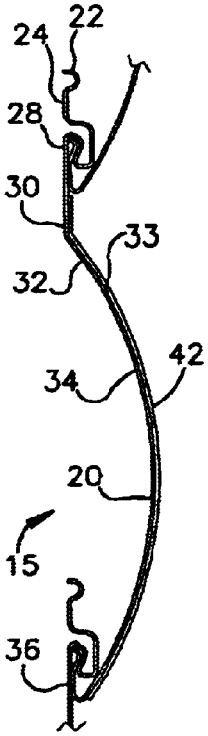
FIG. 2 is a side view of the siding panel of FIG. 1.
Figure 3:
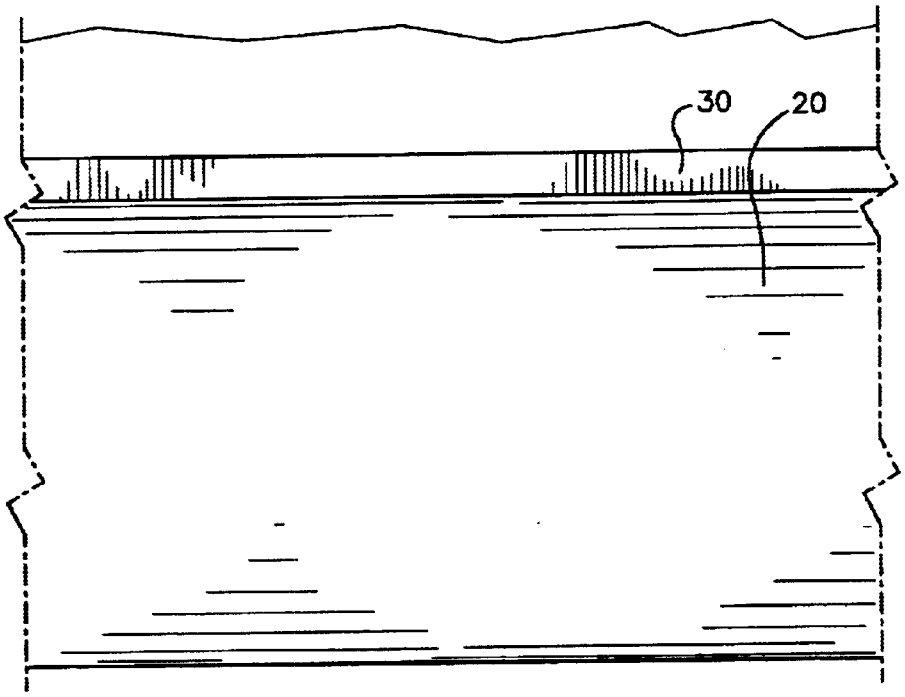
FIG. 3 is a front view of the siding panel of FIG. 1.
Figure 4:
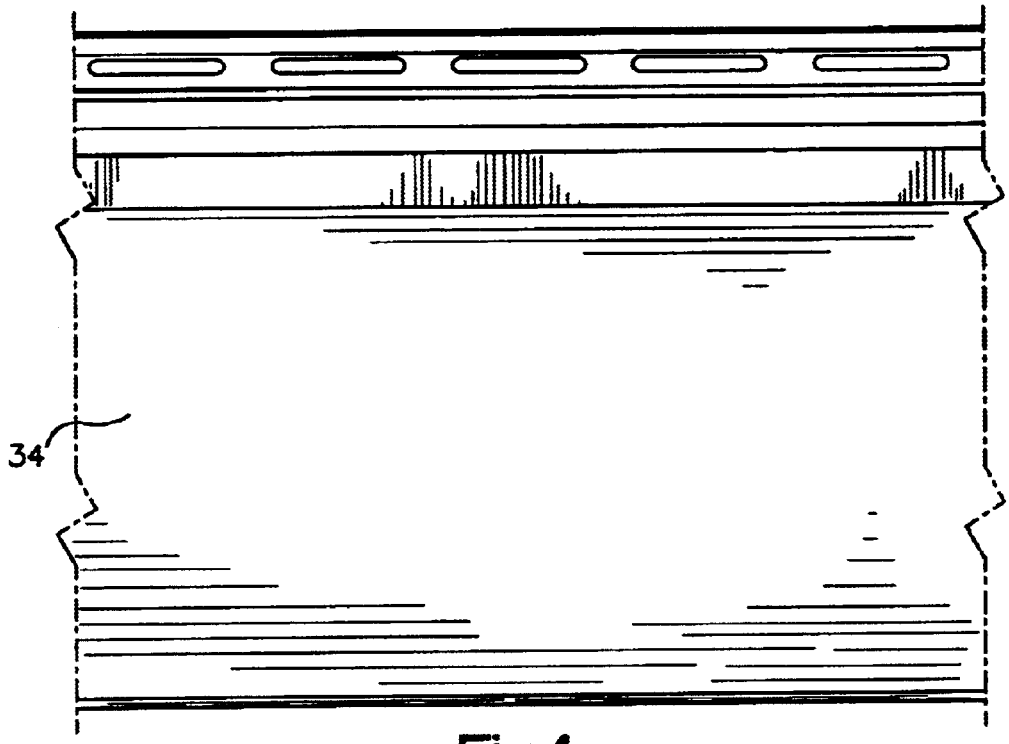
FIG. 4 is a rear view of the siding panel of FIG. 1.

Referring to FIGS. 2 and 6, a panel 20 having a width defined by a first edge 18 and a second edge 19 is shown. Each panel 20 includes multiple, integrally formed sections 22, 24, 28, 30, 32, and 36. At the top of a horizontally disposed panel is a top section 22. The top section 22 has a C-shaped cross section (shown as a backwards "C" in FIG. 2). Below and adjacent to the top section 22 is a mounting section 24. The mounting section 24 is flat and may include one or more elongate horizontal slots 26. The slots 26 allow the panel 20 to be attached to a structure such as by one or more fasteners. Adjacent and below the mounting section 24 is a female locking flange section 28 also referred to as a connecting channel. The female locking flange section 28 functions as part of an interlocking joint between neighboring panels 20 within siding 15. The female locking flange section 28 of a first panel interlocks, such as by snap-fit, with the male locking flange section 36 of a neighboring panel. This locking function helps create a water barrier which in turn protects the underlying structure. The female locking flange section 28 has an S-shaped cross section. The female locking flange section 28 has a channel opening oriented generally toward a bowed section 32 of the panel 20 and connected to a flat vertical section 30 of the panel 20. Adjacent and below the female locking flange section 28 is a flat vertical section 30. The flat vertical section 30 simulates mortar or chinking, between adjacent logs in a log structure. When adjacent panels 20 are interlocked, the flat vertical section 30 remains uncovered and, thus, visible to an observer. Adjacent and below the flat vertical section 30 is the bowed section 32. The bowed section 32 has a first end substantially coincident with the first edge 18 of the panel 20. The bowed section 32 includes a convex exterior surface 33, which resembles the surface of a log, and a concave interior surface 34. The cross section of the bowed section 32 is an arc which measures greater than approximately 5 degrees of a full 360 degree circle and less than approximately 180 degrees of a full 360 degree circle. Adjacent to the bowed section 32 is a male locking flange section 36 also referred to as a snap tab member. The male locking flange section 36 functions as part of an interlocking joint between neighboring panels within siding. The male locking flange section 36 is connected to the first end of the bowed section 32 via a radiused, generally acute angle and oriented generally toward the interior concave surface of the bowed section 32. The end of the male locking flange 36 may be flared. The male locking 36 flange can be pressed into the channel of the female locking flange 28 until it snaps into a locked position.

A film 42 may be used in conjunction with the panel to create a siding with increased durability, weather resistance and varied decorative effect. The film 42 is adhesively attached to the exterior convex surface 33 of the bowed section 32 of the panel 20. The film 42 may also be adhesively attached to the flat vertical section 30. The film can include a wood grain design and/or a mortar design. When using a film with both a wood grain design and a mortar design, the wood grain design is attached over the exterior convex surface 33 and the mortar design is attached over the flat vertical section 30. The film 42 may comprise polyvinylidene fluoride (PVDF) in addition to a mixed metal oxide pigment system. One known suitable film for use is manufactured by Avery Denison and is identified by the trademark AVLOY®.

Insulation may be used in conjunction with the siding 15 to provide sound absorbing or heat retaining properties. An insulating backer board, in a shape known in the art, may be attached to the panel 20. The backer board may comprise a foamed material. The backer board attaches to the concave interior surface 34 of the bowed section 32 of the panel 20.

Individual panels are produced by an extruding process. The extrusion process can be co-extrusion or mono-extrusion. After extrusion, the panels can be further formed to achieve the designed shape.

Although it will be appreciated that panels of differing dimensions and thickness may be manufactured to simulate different types of logs, and exemplary panel can have a nominal length of approximately 145 inches and a thickness without attached film of approximately 0.035 inches. Similarly, films may also have varying thickness, however, an exemplary nominal thickness can be approximately 0.007 inches.

Although the invention has been shown and described with reference to certain embodiments, the invention is not limited to these specific embodiments. Minor variations and insubstantial differences in the various combinations of materials and methods of application may occur to those of ordinary skill in the art while remaining within the scope of the invention as claimed and equivalents.

What is claimed is:

1. An elongate siding panel for use on a structure to simulate log construction, said siding panel comprising:

a first and a second edge defining a width of said panel;

a bowed section having a convex outer surface for resembling a portion of a log, said bowed section having a first end substantially coincident with said first edge;

a snap tab member connected to said first end of said bowed section via a radiused, generally acute angle and oriented generally toward an interior, concave surface of said bowed section;

a backer board affixed to the interior concave surface of the bowed section;

a flat section for resembling mortar between adjacent logs in log construction, said flat section adjacent and connected to second end of said bowed section;

a connecting channel having a channel opening oriented generally toward said bowed section, said channel adjacent and connected to said flat section;

and a generally flat mounting section adjacent and connected to said channel, said mounting section proximate said second edge;

wherein said snap tab member is adapted to snappingly engage a connecting channel of an adjacent panel when used on the structure.

2. The siding panel of claim 1 made from Polyvinyl Chloride.

3. The siding panel of claim 1 made from aluminum.

4. The siding panel of claim 1 wherein the exterior convex outer surface of said panel is textured to simulate wood grain.

5. The siding panel of claim 1 further including one or more slots within said generally flat mounting section to allow mounting of said siding panel to a structure.

6. The siding panel of claim 1 wherein said mounting section includes a plurality of slots allowing the siding to be attached to a structure.

7. An elongate siding panel for use on a structure to simulate log construction, said siding panel comprising:

a first and a second edge defining a width of said panel;

a bowed section having a convex outer surface for resembling a portion of a log, said bowed section having a first end substantially coincident with said first edge;

a snap tab member connected to said first end of said bowed section via a radiused, generally acute angle and oriented generally toward an interior, concave surface of said bowed section;

a flat section for resembling mortar between adjacent logs in log construction, said flat section adjacent and connected to a second end of said bowed section;

a connecting channel having a channel opening oriented generally toward said bowed section, said channel adjacent an connected to said flat section;

and a generally flat mounting section adjacent and connected to said channel, said mounting section proximate said second edge; and a film for simulating long log construction, said film is adhesively attached to the exterior convex outer surface of the bowed section;

wherein said panel, excluding said film, is made from Polyvinyl Chloride and wherein said snap tab member is adapted to snappingly engage a connecting channel of an adjacent panel when used on the structure.

* * * * *